US006135326A

United States Patent [19]

Lee

[11] Patent Number: 6,135,326

[45] Date of Patent: Oct. 24, 2000

[54] BOTTLE CAP DEPRESSABLE TO EJECT CONTENTS OF THE BOTTLE

[75] Inventor: Yu-Kang Lee, Taipei, Taiwan

[73] Assignee: Jung Kuo Enterprise Co., Ltd., Taipei, Taiwan

[21] Appl. No.: 09/427,718

[22] Filed: Oct. 27, 1999

[51] Int. Cl.[7] ..... B65D 88/54

[52] U.S. Cl. ..... 222/321.9

[58] Field of Search ..... 222/321.9, 321.3

[56] References Cited

U.S. PATENT DOCUMENTS 5,738,250 4/1998 Gillingham et al. ..... 222/321.9 X
5,775,547 7/1998 Foster et al. ..... 222/321.9 X

FOREIGN PATENT DOCUMENTS 3529659 2/1987 Germany ..... 222/321.9
186189 11/1959 Sweden ..... 222/321.9

*Primary Examiner*—Kevin Shaver
*Assistant Examiner*—Thach H. Bui
*Attorney, Agent, or Firm*—Rosenberg, Klein & Lee

[57] ABSTRACT

A bottle cap depressable to eject contents of the bottle comprises a cover, a straw combination and an outlet head. The cover is connected to the neck of the bottle, and has a central hole having a guide flange therearound. The straw combination has a tapering depressing tube passed through the central hole of the cover, and connected to the outlet head from the upper end thereof. The tapering depressing tube tapers towards the upper end such that the depressing tube can move smoothly with both the taper thereof and the guide flange of the cover when the outlet head is depressed and released repeatedly to eject the contents of the bottle for use.

1 Claim, 4 Drawing Sheets

BOTTLE CAP DEPRESSABLE TO EJECT CONTENTS OF THE BOTTLE

BACKGROUND OF THE INVENTION

Bottles with a cap depressable to eject contents are often used for holding liquid detergents, shampoo, hair spray, etc.

Referring to FIG. 4, a heretofore known bottle cap depressable to eject contents comprises a connecting member 10, a straw combination 20 and an outlet head 30.

The connecting member 10 is screwed onto the neck of the bottle used for holding liquid detergent.

The straw combination 20 is connected to the connecting member 10, and has a holding tube part 201, a steel ball 202, a spring 203, a depressing tube 204 and a locating member 205.

The steel ball 202 is located on an exit hole of the holding tube part 201. The spring 203 is located on the steel ball 202. The depressing tube 204 has an upper end portion projecting out from a central hole 206 of the connecting member 10, and a lower end portion movably received in the holding tube part 201; the lower end of the depressing tube 204 is located on the spring 203.

The outlet head 30 is connected to the depressing tube 204 of the straw combination 20 such that liquid can be ejected through the outlet head 30 and the straw combination 20.

When the outlet head 30 is depressed and released, the liquid held in the bottle can be ejected through the straw combination 20 and the outlet head 30 for use, the spring 203 biasing the depressing tube 204 upwards when the outlet head 30 is released.

However, it is found that the straw combination has undesirable features as follows.

1. In order for the depressing tube to move downwards smoothly, a space is provided between the depressing tube and the holding tube part. The depressing tube is likely to sway when it is depressed.
2. The depressing tube has the upper end portion projecting out from the connecting member 10 for a relatively long distance, and furthermore, the lower end portion of the depressing tube is only located by a lower end rim (not numbered) and the central hole 206 of the connecting member. Consequently, it may likely to sway owing to the bad support of the depressing tube when we depress the depressing tube.

SUMMARY OF THE INVENTION

It is a main object of the present invention to provide a bottle cap depressable to eject contents of the bottle. When depressed, the bottle cap cannot sway and can be pressed up and down relatively smoothly to eject the contents.

The bottle cap of the present invention comprises a cover member connected to a neck of the bottle. The cover has a central hole having a guide flange around the central hole. A straw combination has a depressing tube projecting out from the central hole of the cover member. The depressing tube tapers towards the upper end. An outlet head connected to the upper end of the depressing tube for permitting the contents of the bottle to be ejected through the straw combination and the outlet head.

The depressing tube can move smoothly with both the taper thereof and the guide flange of the cover member when the outlet head is depressed and released repeatedly to eject the contents for use. Moreover, the guide flange can also prevent the depressing tube from swaying when moving up and down.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
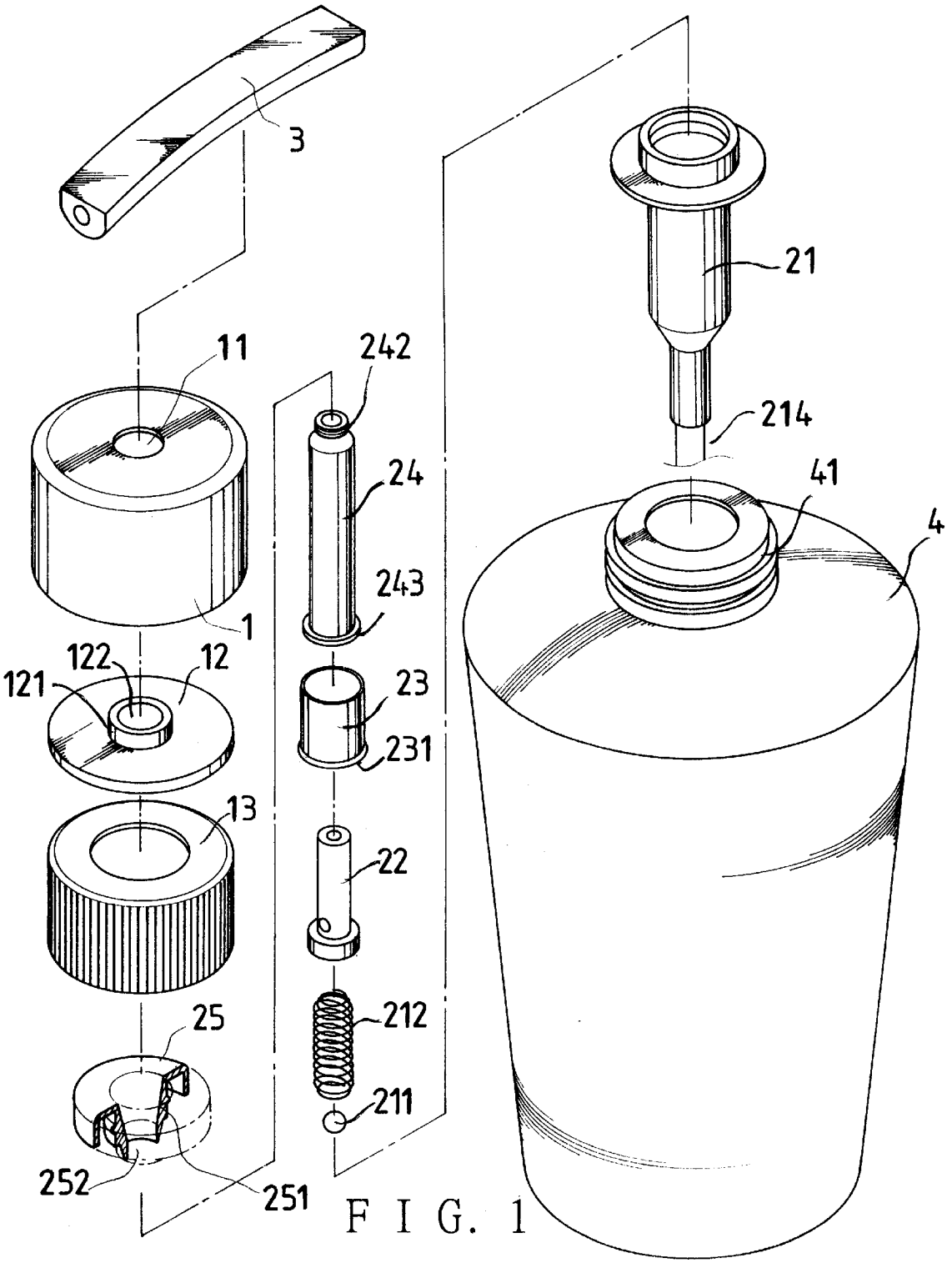
FIG. 1 is an exploded perspective view of a bottle with a cap depressable to eject contents of the bottle according to the present invention.

Referring to FIG. 1, a bottle cap depressable to eject contenst of the bottle of the present invention comprises a cover 1, a straw combination 2 and an outlet head 3 as the main parts.

The cover 1 has a central hole 11, and has an inner room connected to a guide member 12 and a connecting part 13. The guide member 12 has a central hole 122, and a guide flange 121 around the hole 122. The connecting part 13 is screwed onto a connecting neck 41 of a bottle 4 provided for holding liquid contents therein; thus, the cover 1 is connected to the bottle 4.

The straw combination 2 comprises a holding tube 21 a pushing rod 22, a locating holder 23, a depressing tube 24 and a fixing member 25. A steel ball 211 and a spring 212 are located between an exit hole 213 of the holding tube 21 and a bottom of the pushing rod 22. A straw 214 is connected to the holding tube 21.

The pushing rod 22 is passed through the locating holder 23. Both the pushing rod 22 and the locating holder 23 are received in the holding tube 21. Furthermore, the locating holder 23 has a lower end rim 231 contacting the inner wall of the holding tube 21.

Figure 2:
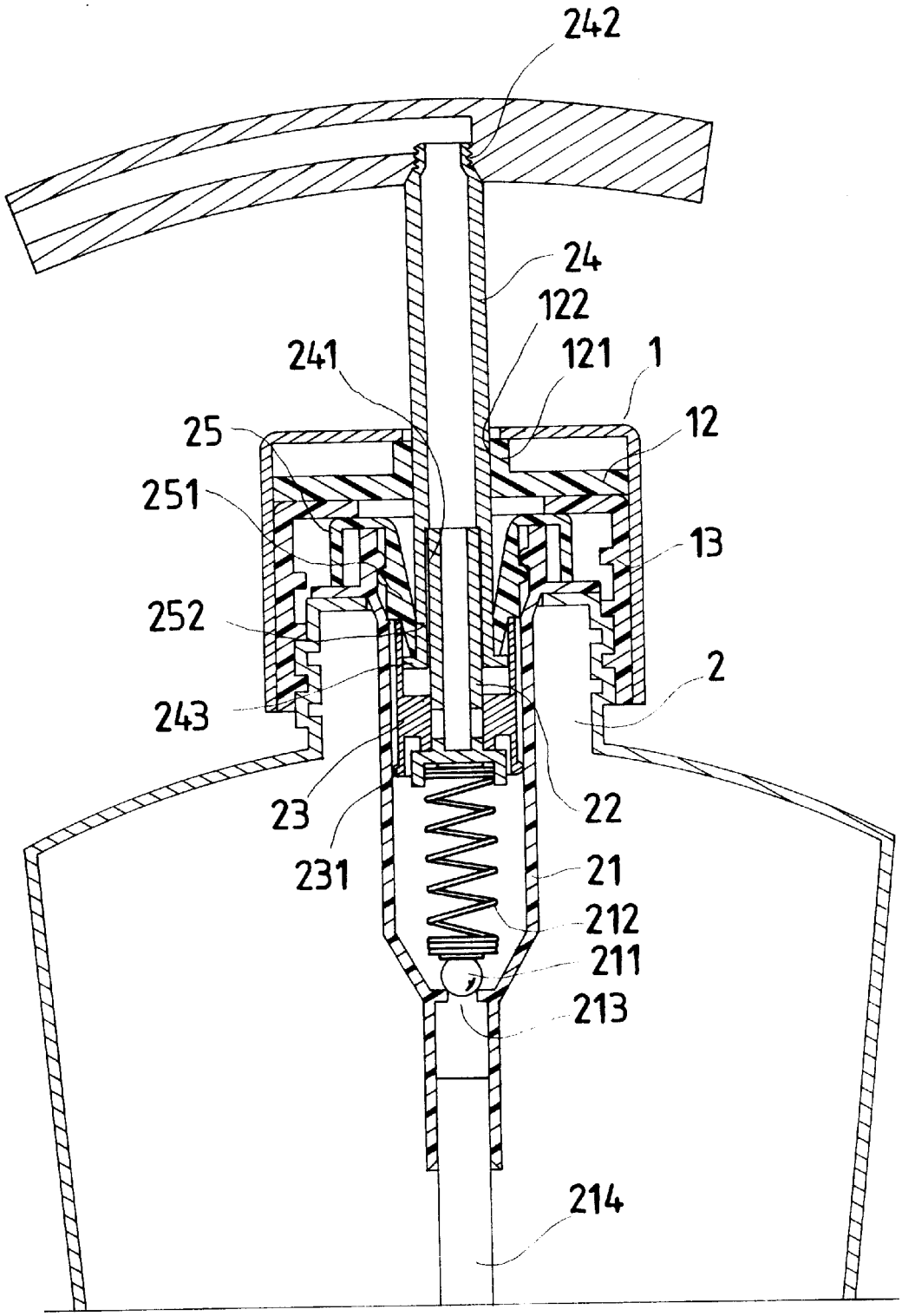
FIG. 2 is a cross-sectional view of the bottle cap of the present invention.
Figure 3:
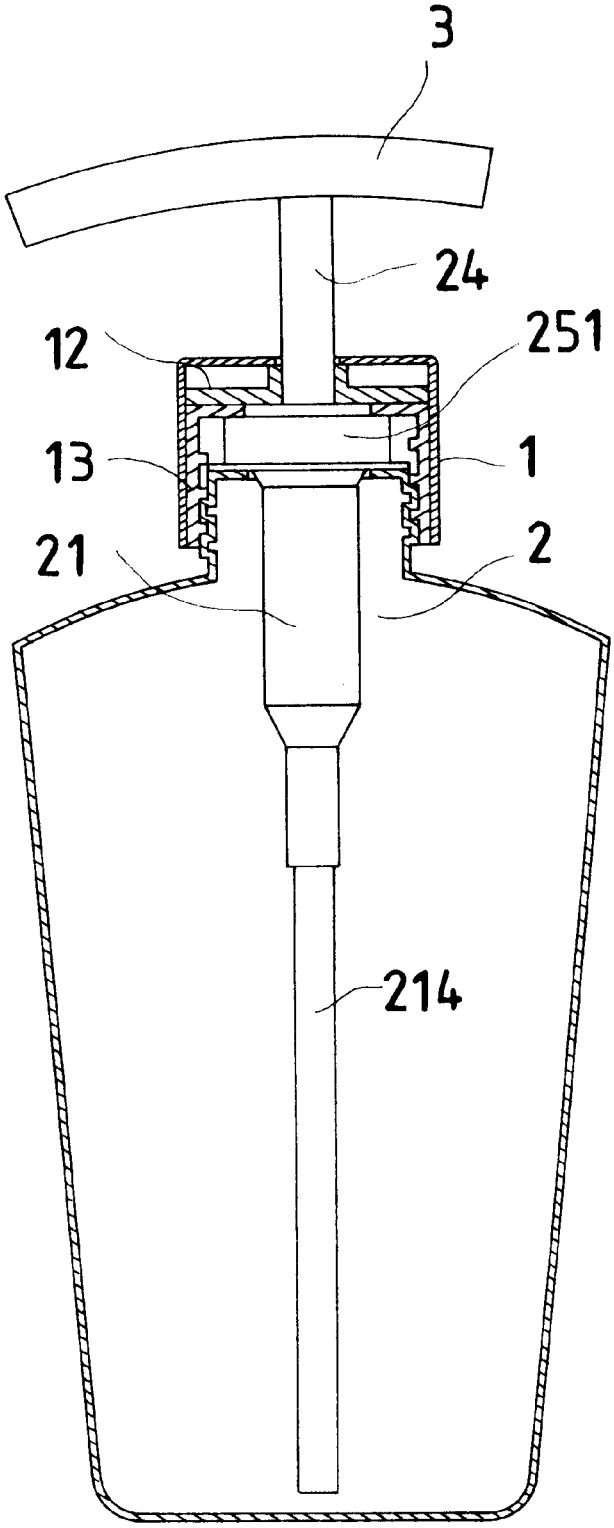
FIG. 3 is a cross-sectional view of the bottle in the FIG. 1.
Figure 4:
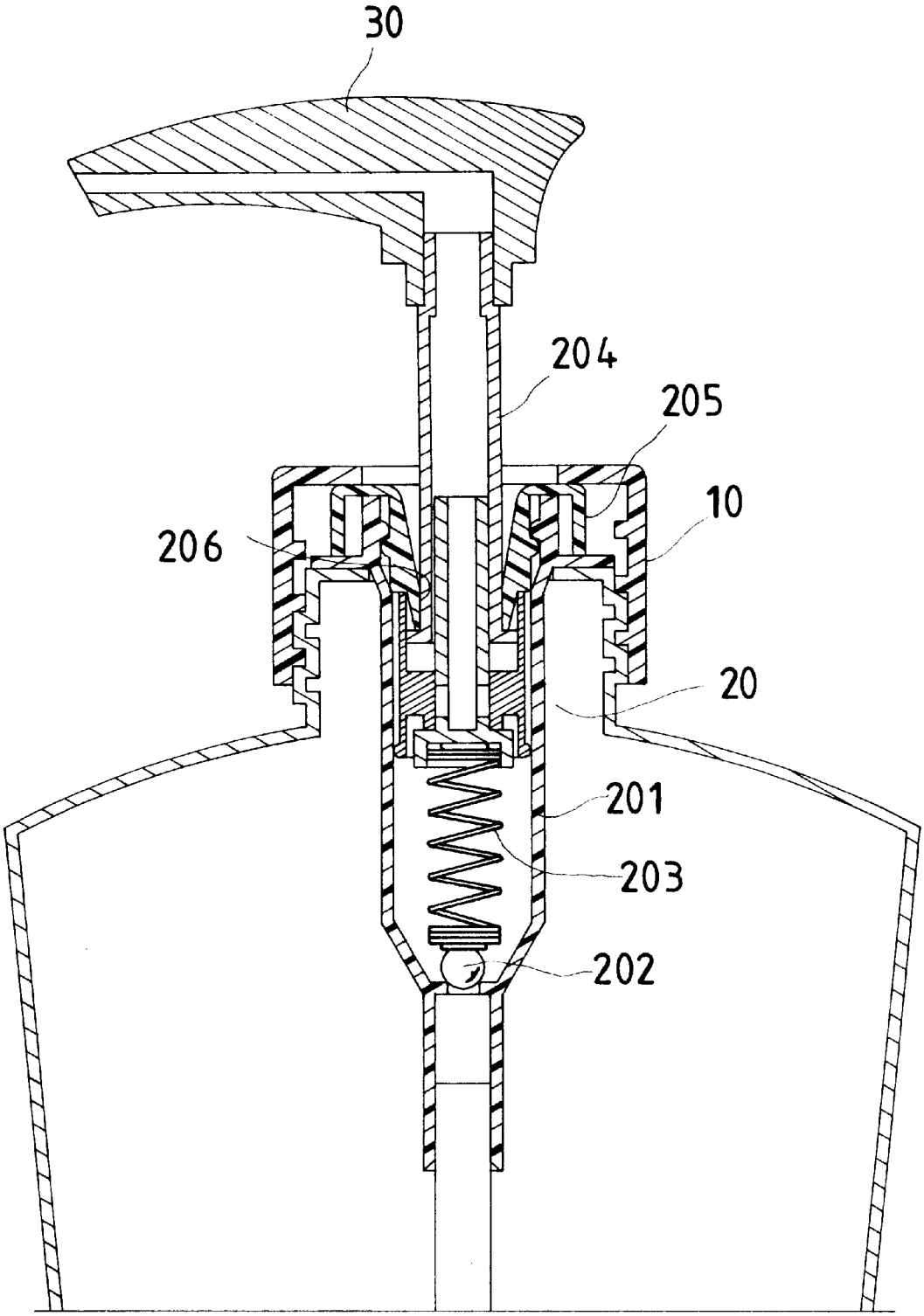
FIG. 4 (PRIOR ART)
FIG. 4 is a cross-sectional view of the prior art bottle cap as described in the background.

The depressing tube 24 has a lower end room 241 receiving the upper end portion of the pushing rod 22 therein. Referring to FIG. 2, a stair is provided inside lower end room 241 of the depressing tube 24 such that the top end of the pushing rod 22 is stopped from moving further up by the stair.

The depressing tube 24 has an upper end portion projecting out from the hole 122 of the guide member 12 and the central hole 11 of the cover 1. The depressing tube 24 further has a threaded end 242, which is screwed into and connected to the outlet head 3 such that liquid can be jected through the straw combination 2, and the outlet head 3. A rim 243 is provided on a lower end of the depressing tube 24. Furthermore, the depressing tube 24 tapers towards the upper ends, i.e. the lower end has a greater circumference than the upper end.

The fixing member 25 has a hole 252 and a guide flange 251 around the hole 252. The fixing member 25 is connected to the upper end of the holding tube 21 for preventing the depressing tube 24 from swaying by means of the guide flange 251. The guide flange 251 also stops the lower end rim 243 of the depressing tube 24 to prevent the depressing tube 24 from moving farther up.

Thus, when the outlet head 3 is depressed and released repeatedly, liquid contents of the bottle 4 can be ejected through the straw combination 2 and the outlet head 3 for use.

The depressing tube 24 is confined by both the guide flange 121 of the guide member and the guide flange 251 of the fixing member 25 so same is not likely to sway when moving up and down. Furthermore, the locating holder 23, into which the depressing tube 24 is passed, has the rim 231 contacting the inner wall of the holding tube 21 so the depressing tube 24 is prevented from swaying in sufficiently.

Moreover, the depressing tube 24 can move upward smoothly with the help of the two guide flanges 121 and 251 because the depressing tube 24 tapers towards the upper end.

From the above description, it can be seen that the depressable cap of the present invention has a desirable feature that the depressing tube can move smoothly and is not likely to sway when the outlet head is depressed and released to eject the contents for use.

What is claimed is:

1. A bottle cap depressable to eject contents of a bottle comprises (a) a cover member screwed onto a neck of the bottle, said cover member having a central hole, and a guide members received therein, said guide member having a central hole, and a first guide flange around said central hole;

(b) a straw combination includes (i) a depressing tube projecting out through said central hole of said guide member and said central hole of said cover member, said depressing tube being supported at one portion thereof by said first guide flange, said depressing tube tapering towards an upper end thereof;

(ii) a spring located under said depressing tube, said spring having a steel ball located thereunder;

(iii) a holding tube, said holding tube having an opening and a second guide flange surrounding said opening for receiving and supporting a lower end portion of s aid depressing tube therein, said holding tube having a tubular locating holder disposed therein with a pushing rod extending through an axial bore of said locating member into an axial bore of said depressing tube, said locating holder having a rim formed at a lower end thereof and contacting an inner wall surface of said holding tube and thereby further providing support of said depressing tube, said holding tube having a straw coupled on a lower end thereof; and, (c) an outlet head connected to said upper end of said depressing tube for permitting said contents of said bottle to be ejected through said straw combination and said outlet head.

* * * * *